United States Patent [19]

Hooton

[11] Patent Number: 4,706,365

[45] Date of Patent: Nov. 17, 1987

[54] METHOD AND APPARATUS FOR ASSEMBLING A RING PIPE ARRANGEMENT

[75] Inventor: Robert D. Hooton, McMinnville, Tenn.

[73] Assignee: Carrier Corporation, Syracuse, N.Y.

[21] Appl. No.: 924,244

[22] Filed: Oct. 20, 1986

[51] Int. Cl.[4] ..... B21D 39/00; B23P 11/00; B23Q 3/00; B23Q 7/04

[52] U.S. Cl. ..... 29/520; 29/523; 29/243.52; 29/283.5; 228/154; 228/173.4; 228/255; 285/382

[58] Field of Search ..... 29/520, 505, 522 R, 29/523, 243.5, 283.5; 228/255, 154, 173.4; 285/382, 382.1, 382.4, 382.5

[56] References Cited

U.S. PATENT DOCUMENTS

| | | | |
|---|---|---|---|
| 1,817,854 | 8/1931 | Sorensen | 285/382.5 X |
| 2,105,933 | 1/1938 | Spencer | 285/382 X |
| 2,120,067 | 6/1938 | Gray | 285/382.5 X |
| 2,615,235 | 10/1952 | Hadley | 228/173.4 X |
| 2,714,389 | 1/1953 | Torii | 228/173.4 X |
| 3,220,098 | 11/1965 | Arbagast | 228/255 X |
| 3,287,949 | 11/1966 | Skinner | 228/255 X |
| 3,930,298 | 1/1976 | Ridenour | 29/523 |
| 3,972,112 | 8/1976 | O'Sickey et al. | 29/520 X |
| 4,130,932 | 12/1978 | Epmeier | 285/382.5 X |
| 4,442,586 | 4/1984 | Ridenour | 29/520 X |

FOREIGN PATENT DOCUMENTS

| | | | |
|---|---|---|---|
| 1241310 | 5/1967 | Fed. Rep. of Germany | 29/520 |

*Primary Examiner*—Charlie T. Moon
*Attorney, Agent, or Firm*—Dana F. Bigelow

[57] ABSTRACT

Method and apparatus effective for emplacing a ring (52) at a selected axial location of a pipe (45) by reducing its diameter and establishing a circumferential bulge (146) adjacent to the selected location and ring (52), said bulge (146) cooperatively resisting axial displacmeent thereof and being in physical conformity therewith.

8 Claims, 3 Drawing Figures

METHOD AND APPARATUS FOR ASSEMBLING A RING PIPE ARRANGEMENT

BACKGROUND OF THE INVENTION

The technical field herein is directed toward the art of securely fastening a metallic ring at a selected location on a pipe or tube, and more particularly toward that portion of the air conditioning arts in which a nipple pipe is subsequently to be brazed in place in a receiving header aperture.

The problem addressed herein is twofold. First, the braze ring slipped over a nipple pipe prior to brazing the nipple pipe or tube in a receiving header aperture tends to slip out of place before brazing is actually accomplished. Second, the current practice of forming an annular bead around the circumference of the nipple pipe spaced a selected distance from an end thereof simply leaves the side of the bead unconformed to the shape of the brazing ring it has to secure as will be seen below.

As suggested, it is desirable in many instances to secure a brazing ring onto a selected location of a nipple pipe, in particular near the end of the nipple pipe for subsequent brazing in a receiving header aperture of an air conditioning system. Simply sliding the braze ring over the end of the nipple pipe in preparation for brazing does not serve to secure the braze ring at any particular location on the pipe in preparation for brazing. It is of course known to establish a bead diameter at an adjacent location to that selected for fastening of the braze ring, thereby permitting the adjacent fitting of the braze ring immediately next to the bead diameter on the pipe.

This nonetheless is inadequate for effectively securing the brazing ring on the pipe, because the brazing ring can still slip off the end of the pipe even though it abuts the bead on one side. The bead only secures the braze ring on one side thereof.

Additionally, the shape of the bead itself is generally unsatisfactory, because it does not conform directly to the shape of the braze ring to effect a secure fit which will accomplish successful attachment.

SUMMARY OF THE INVENTION

According to the invention, a ring of selected material, preferably a brazing material such as for example a phosphorus copper alloy, is emplaced upon the diameter of a selected pipe at a predetermined location thereof in order to compress the ring and the pipe at that location and to establish a pipe bead adjacent to the ring. This is done by slipping the ring over the end of the pipe in a manufacturing fixture used for holding the pipe itself during manufacture, and axially compressing the ring with a stepped mandrel inserted into the end of the pipe to prepare for forming operation. The manufacturing arrangement is then employed to first crimp the ring onto the selected location of the pipe, and finally to axially compress the pipe, thereby establishing a generally circumferential bead which bulges out immediately adjacent the position of the ring and conforms on one side to the shape of the ring.

DESCRIPTION OF THE PREFERRED EMBODIMENT

Figure 1:
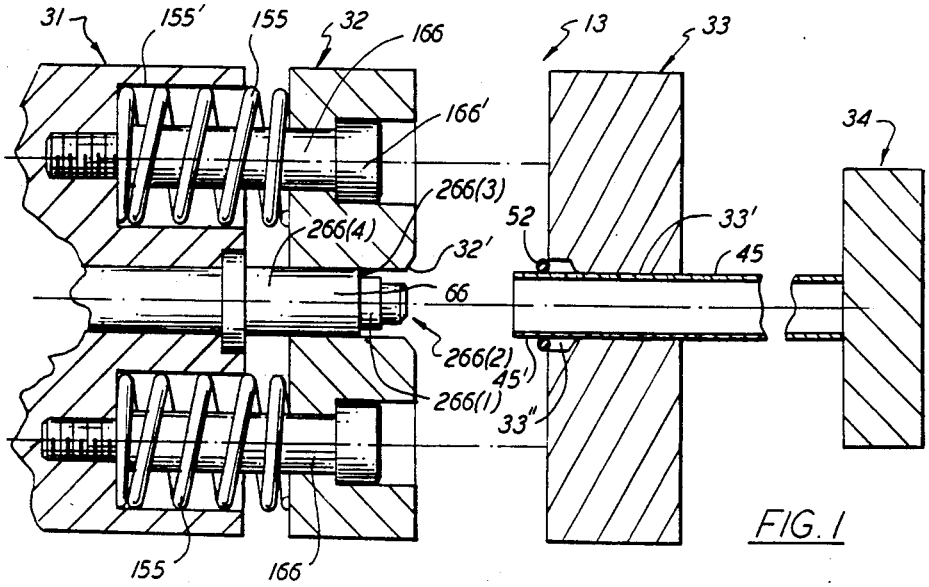
FIGS. 1 and 2 show in cross section the manufacturing fixture or arrangement for holding and crimping the ring in place on the pipe, and for establishing a bead for adjacently, conformingly supporting the ring on one side thereof, in first and second positions of operation, respectively the beginning and end of a single stroke of the arrangement during operation.

FIG. 1 shows the arrangement 13 according to the invention herein, including manufacturing fixture elements 31, 32, 33 and 34 which operate on pipe 45 to emplace brazing ring 52 thereupon for subsequent brazing operation according to the technique described immediately below.

Figure 2:
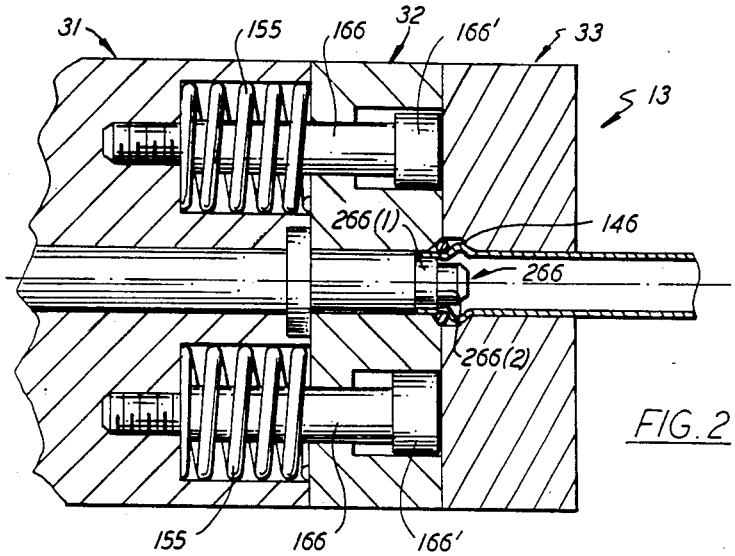
Figure 3:
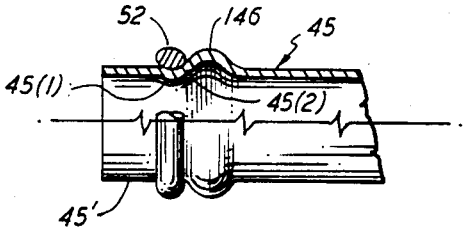
FIG. 3 shows a portion of the finished pipe including the bead formed thereupon and the ring crimped adjacently thereto at a selected location, taken in partial axial cross section.

Elements 31–34 are part of a machine which holds pipe 45 in place while plunging stepped mandrel 66 thereinto at one end 45' thereof to establish a circumferential bead 146, as shown in FIGS. 2 and 3 in pipe 45, and additionally to compress ring 52 about pipe 45 at a selected location immediately adjacent to bead 146. This establishes a substantially circumferential depression in pipe 45 adjacent bead 146, which conforms the shape of bead 146 to the shape of ring 52 to promote effective holding an emplacement of ring 52 upon pipe 45.

FIG. 1 particularly shows machine elements 31–34 in terms of their function. For example, element 34 for example serving effectively to hold the end of pipe 45 in place to prevent its recession. Element 32 is effective to advance toward pipe 45 with stepped mandrel 66 to be inserted into the end 45' of pipe 45. As can be seen in FIG. 1, machine element 32 is spring biased toward pipe 45 from element 31, so that when elements 31 and 32 are jointly transported toward pipe 45 during operation under the influence of conventional motive means (not shown), springs 155 will be compressed.

Carefully viewing the relationship between elements 31 and 32 as show in FIG. 1, it is clear that the Figure further discloses that element 32 is held onto element 31 by bolts 166 which are slidably inserted through a cooperative aperture in element 32 with its head 166' limiting maximum departure of element 32 from element 31 during maximum extension of spring 155. According to one version of the invention, bolts 166 are threadedly inserted into the body of element 31 through respective springs 155. Springs 155 in turn are held in respective spring apertures 155' defined in the body of element 31.

Similarly, mandrel 66 is mounted in a recess 66' defined in both elements 31 and 32. As can be seen, the tip 266 of mandrel 66 includes upper and lower stages, respectively 266(1) and 266(2). The lower stage 266(2) has its end slightly bevelled, as does the inner side or bevelled portion 32' of element 32 adjacent the tip 266 of mandrel 66. The angle of bevel is for example sixty (60) degrees from the axial direction.

As a result, when elements 31 and 32 are moved jointly toward pipe 45 and elements 33 and 34 during operation, the end 45' of pipe 45 slides between the bevelled portions of mandrel 66 and element 32, thereby insuring correct alignment therebetween. As operation proceeds, the lower stage 266(2) of mandrel 266 will enter the end 45' of pipe 45 and thereafter the bevelled portion 32' of element 32 will engage braze ring 52, pushing ring 52 into aperture 33'', as will be seen.

In particular, FIG. 1 shows element 33 defining a central aperture 33' for transversely holding pipe 45 in place, and aperture 33′ in turn has a widened portion 33″ which is larger in diameter than the remainder of the aperture 33′ by an amount which is less than the outer diameter of the braze ring 52, and preferably for example about ten (10) percent less. Further, the length of penetration of widened portion 33″ into element 33 is several times the diameter of the braze ring 52.

It follows that engagement with the bevelled portion 32′ of element 32 will result in compression of ring 52 (the ring being preferably gapped to facilitate such compression in diameter), and its partial or complete insertion into aperture 33″.

Furthermore, the movement of element 32 against ring 52 will cause a reduction in diameter of pipe 45 concomitant with the reduction of diameter of ring 52 and at the same axial location as the diameter reduction thereof occurs. This diameter reduction of pipe 45 by compression of ring 52 at the selected axial location of pipe 45 is of course limited by the outer diameter of the lower level 266(2) being defined to fit snugly within pipe 45. Further, the general diameter of mandrel 66 is the same as that of pipe 45. As can be seen in FIGS. 1 and 2, the downstep of mandrel 66 from general diameter to upper level 266(1) defines a ledge 266(3) against which the end of pipe 45 can bear effectively during operation, to accomplish the crimping of pipe 45, which entails and encompasses both circumferential diameter reduction at a selected location and bulging expansion thereof into a substantially circumferential bead immediately adjacent thereto, as indicated herein.

In summary, the movement of element 32 is effective to accomplish diameter reduction for both ring 32 and pipe 45 at corresponding axial locations. The reduction in pipe diameter of course creates both a diameter downswing 45(1) and a diameter upswing 45(2) in the radial direction from the center of pipe 45, as suggested in FIG. 3. With the ledge 266(3) of mandrel 66 between general diameter 266(4) and upper level 266(1) pushing the end 45′ of pipe 45 against element 34 in an axial direction effective for establishing compressive forces upon ring 45, the pipe 45 will begin to bulge or expand circumferentially in diameter into a substantially circumferential bead 146 to the maximum permitted by the outer diameter aperture 33″. The shape of this bulging is also bounded and conformed by the influence of ring 52, ensuring that the shape of ring 52 conforms to the shape of the diameter of compressed ring 52.

Accordingly, it follows that ring 52 will be well seated on pipe 45 both because of its diameter reducing a depressed circumferential portion of pipe 45, and because of its intimate, cooperative fit with bulge or circumferential bead 146.

This enhances the ease of operation during construction and brazing nipple pipes 45 into headers (not shown) on air conditioning systems which can effectively employ the inventive techniques set forth herein.

While this invention has been described with reference to a particular embodiment disclosed herein, it is not confined to the details set forth herein and this application is intended to cover any modifications or changes as may come within the scope of the invention.

What is claimed is:

1. The method of emplacing a ring upon the outer diameter of a selected pipe at a predetermined axial location, comprising the steps of:

(a) slipping the ring over the end of the pipe to the predetermined location, (b) holding the end of the pipe to resist axial displacement, (c) compressing the ring to reduce its diameter and that of the portion of the pipe at which it is positioned, and (d) axially compressing pipe until it bulges adjacent the region of diameter reduction, whereby said ring is fixedly emplaced upon said pipe.

2. The method of claim 1, wherein said ring comprises brazing material.

3. Apparatus for emplacing a selected ring at a predetermined location on a pipe, comprising:

means for holding said pipe at a selected location, and effective for defining an aperture wider than the diameter of the pipe and smaller than the outer diameter of said ring, radial means for radially compressing said ring at a selected axial location of said pipe, whereby a circumferential depression is established in said pipe, and axial means for axially compressing said pipe, said axial means effective for establishing a circumferential bulge in said pipe adjacent said circumferential depression, whereby said ring is fixedly emplaced upon said pipe.

4. The apparatus of claim 2, further comprising a mandrel for insertion into said pipe.

5. The apparatus of claim 3, wherein said mandrel has a stepped tip.

6. The apparatus of claim 2, wherein radial means is spring biased against said axial means.

7. The apparatus of claim 5, wherein said spring bias is exercised axially.

8. The apparatus of claim 3, wherein said ring comprises brazing material.

* * * * *